United States Patent [19]

Moss

[11] Patent Number: 4,615,527

[45] Date of Patent: Oct. 7, 1986

[54] OIL GAME OF SKILL AND CHANCE

[76] Inventor: Robert J. Moss, Rte. #1, Box 8-G, Hoxie, Kans. 67740

[21] Appl. No.: 633,486

[22] Filed: Jul. 23, 1984

[51] Int. Cl.[4] ..... A63F 3/00

[52] U.S. Cl. ..... 273/278; 273/282; 273/284

[58] Field of Search ..... 273/254, 284, 256, 241, 273/282 R, 243, 280, 287, 271; 434/334, 345, 364

[56] References Cited

U.S. PATENT DOCUMENTS

| | | | |
|---|---|---|---|
| 557,646 | 4/1896 | Booth | 273/284 X |
| 2,299,803 | 10/1942 | Deaton | 273/278 |
| 2,512,820 | 6/1950 | Bader | 273/284 X |
| 3,061,313 | 10/1962 | Greene | 273/243 X |
| 3,127,176 | 3/1964 | Ryan | 434/334 X |
| 3,139,688 | 7/1964 | Roop | 434/334 |
| 3,458,199 | 7/1969 | Nelson | 273/249 |
| 3,698,716 | 10/1972 | Rattey, Jr. | 273/287 X |
| 3,729,198 | 4/1973 | Shaffer | 273/243 |
| 3,801,104 | 4/1974 | Potts et al. | 273/239 |
| 3,844,567 | 10/1974 | Marker | 273/254 X |
| 4,025,075 | 5/1977 | Priska et al. | 273/278 |
| 4,114,892 | 9/1978 | Csoka | 273/280 X |

FOREIGN PATENT DOCUMENTS

| | | | |
|---|---|---|---|
| 1248344 | 8/1967 | Fed. Rep. of Germany | 434/334 |
| 152518 | 10/1920 | United Kingdom | 273/282 C |

*Primary Examiner*—Richard C. Pinkham
*Assistant Examiner*—Matthew L. Schneider
*Attorney, Agent, or Firm*—Richard L. Miller

[57] ABSTRACT

A game of skill and chance which simulates the excitement and frustrations of drilling for oil. Playing pieces, representing oil drilling rigs are inserted through apertures in a top deck and, if unhindered, proceed through to a lower deck. However, a sliding middle deck is inserted between the other two decks which has only some of the holes so that a drilling rig has a real probability of being blocked and therefore results in a "dry well". Due to the symmetrical nature of the decks, the sliding middle deck may be removed from a specially provided channel, rotated along any plane and then re-inserted. This provides eight different playing configuration from a single sliding deck. Additional decks may be provided for increased variety.

5 Claims, 3 Drawing Figures

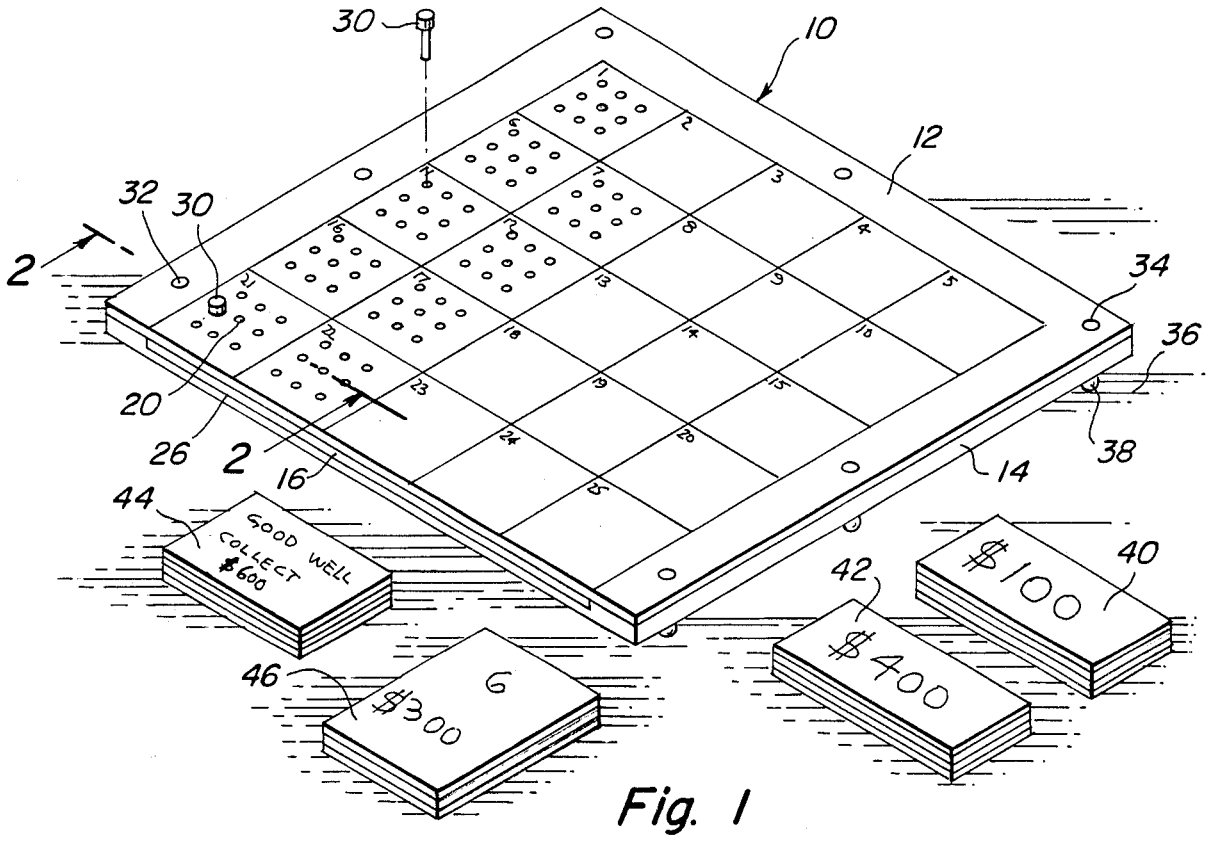
Fig. 1
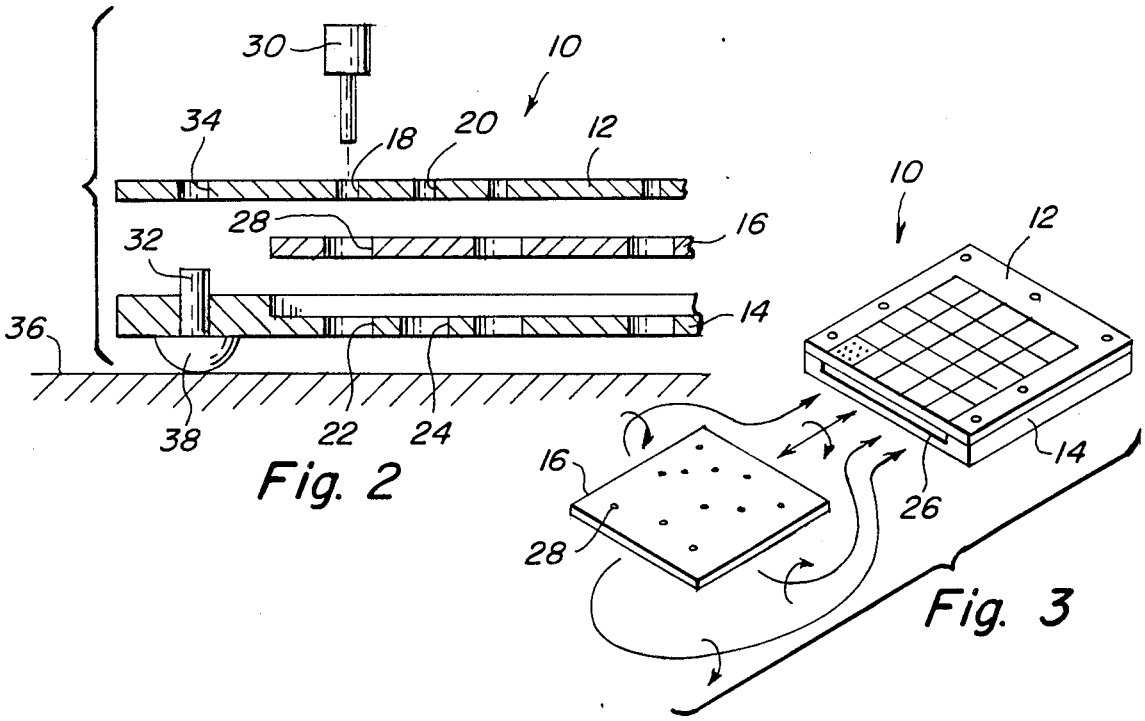
Fig. 2
Fig. 3

OIL GAME OF SKILL AND CHANCE

BACKGROUND OF THE INVENTION

The present invention relates generally to the field of amusement devices and, more specifically, to board type games which can be used to simulate the perils and pleasures of drilling for oil.

The recent energy crises and petroleum shortages have raised public interest in oil exploration and its risks and benefits. A number of "drilling for oil" games have been suggested which are completely different than the game herein presented. G. Dolansky (U.S. Pat. No. 4,384,721) provides an oil exploration game in which rotating cams are used to variously control simulated oil drilling equipment. C. Deaton (U.S. Pat. No. 2,299,803) provides a game in which blocks, hidden from view, are shaken to shift their position between two boards and when a playing piece is blindly inserted through openings in a top board blockages or lacks of blockages are scored. Priska et al. (U.S. Pat. No. 4,025,075) provides a wildcat oil well drilling game in which the insertion of oil well rig playing pieces is limited by the topography of a rotatable stepped platform hidden beneath the top playing board.

SUMMARY OF THE INVENTION

It is, therefore, a primary object of the present invention to provide Gopher Oil, a game of chance and skill, in which playing pieces which represent oil drilling rigs may be inserted into apertures representing test sites in an oil field.

A further object is to provide Gopher Oil, a game of chance and skill, in which the penetration or lack of penetration of the playing pieces into the oil well drilling sites may be used for scoring the game.

A further object is to provide Gopher Oil, a game of chance and skill, in which the penetration described is limited by the presence or absence of apertures in a middle sliding deck sandwiched between an upper deck and a lower deck.

A yet further object is to provide Gopher Oil, a game of chance and skill, in which the location of "open" or "blocked" test sites may be varied by removing a sliding deck and rotating it in any plane and re-inserting it into a sliding deck channel, thereby providing up to eight different playing configurations from a single sliding deck.

A yet further object is to provide Gopher Oil, a game of chance and skill, in which additional combinations of "open" or "blocked" test sites may be varied by the insertion of different sliding decks into a sliding deck channel.

A still further object is to provide Gopher Oil, a game of chance and skill, which is simple and inexpensive to fabricate.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the invention with all of its components.

FIG. 2 is a partial exploded cross sectional view taken along line 2—2 in FIG. 1.

FIG. 3 is a diagrammatic view illustrating how the sliding deck may be inserted in eight different position into the game board housing.

DETAILED DESCRIPTION OF THE PREFERRED EMBODIMENTS

The invention 10 is made of a sandwich of three basic component parts: a square upper deck 12, a square lower deck 14 and a square sliding deck 16; all of which may be made of any rigid sheet material including tin, composition board, plywood, brass, etc. Apertures on upper deck 12, typified by 18 and 20 are clustered into twenty-five groups of nine, and each group may be made to represent an oil drilling field where each aperture represents an oil drilling test site. Corresponding, but larger, apertures are provided on lower deck 14 with typical apertures 22 and 24 corresponding to upper deck apertures 18 and 20 respectively.

Sliding deck 16 is provided with apertures typified by 28 which correspond to some, but not all, of the apertures provided in upper deck 12 and lower deck 14. During play, a playing piece, representing an oil well drilling rig, typified by 30 may be inserted into aperture 18, for example. Since the diameter of aperture 18 is relatively small, a player will not be able to visually detect the presence or absence of a corresponding aperture in the sliding deck 16 below aperture 18. However, a playing piece inserted into aperture 18 in the upper deck 12, will pass through a corresponding aperture 28 in the sliding deck 16 and proceed into aperture 22 in lower deck 14. This might represent an "oil strike". However, a playing piece inserted into aperture 20 in upper deck 12 will be blocked by the lack of a corresponding aperture in sliding deck 16. This might represent a "dry well".

Because of the square symmetry of the configurations of apertures, play may be varied by rotating sliding deck 16 in the direction of any of the arrows shown in FIG. 3 and then re-inserting sliding deck 16 into sliding deck channel 26, in any one of eight different ways.

The invention 10 is held together in alignment by a plurality of collars typified by collar 32 which fits snugly into apertures typified by 34. Lower deck 14 is held at a fixed height above playing surface 36 by a multiplicity of support feet typified by 38. Accessory playing components include bogus playing money such as 40 and 42 and instruction cards such as 44 and 46. Bogus money may have one color representing money earned and another color representing money borrowed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A game of skill and chance, comprising in combination:

(a) a square upper deck with a multiplicity of apertures;

(b) a square lower deck with a multiplicity of apertures which exactly match the configuration of said apertures in said upper deck and which is permanently fixed in position relative to said upper deck;

(c) a square sliding deck with a multiplicity of apertues less than the number of apertures in the upper and lower decks, wherein said sliding deck is sandwiched between said upper deck and lower deck; wherein said apertures that are present in said sliding deck are in perfectly aligned relationship with apertures in said upper deck and said lower deck; said apertures in all of said decks being subdivided into identical clusters of apertures wherein each of said clusters of apertures are rotationally symmetrical with respect to the center of each of said clusters and each of said clusters are spaced apart from the next cluster a greater distance than the spacing of the apertures within a cluster, said clusters of apertures being arranged such that all of said clusters are rotationally symmetrical with respect to a centrally located cluster, whereby said sliding deck can be rotated in any multiple of 90 degrees and inverted any number of times and upon reinsertion is still in alignment with the apertures in said upper and lower decks;

(d) a sliding deck track which permits said sliding deck to be inserted, removed, rotated, inverted, and reinserted; and (e) at least one cylindrically shaped playing piece which is inserted into any of said apertures in said upper deck; wherein said playing piece will pass through said sliding deck into said lower deck if an aperture has been provided in said sliding deck; whereby an insertion of said playing piece may be scored by virtue of whether or not it may be completely inserted.

2. A game of skill and chance, as recited in claim 1, wherein the diameter of said apertures in said upper deck is less than the diameter of said apertures in said sliding deck and in said lower deck; whereby a player may not easily see which of said apertures in said upper deck have been provided with corresponding apertures in said sliding deck.

3. A game of skill and chance, as recited in claim 1, wherein the thickness of said upper deck is sufficient to retain said playing pieces in an upright position when the downward travel of said playing pieces are limited by the absence of an aperture in said sliding deck.

4. A game of skill and chance, as recited in claim 1, further comprising a plurality of support feet which keep said lower deck at a fixed height above a playing surface.

5. A game of skill and chance, as recited in claim 1, further comprising a plurality of collars which are permanently attached to said lower deck and which pass through corresponding apertures in said upper deck thereby aligning said decks and providing a rigid, stable structure.

* * * * *